US012571608B2

(12) United States Patent
Kung et al.

(10) Patent No.: US 12,571,608 B2
(45) Date of Patent: Mar. 10, 2026

(54) HANDGUARD EXHAUST STRUCTURE OF FIREARM

(71) Applicant: VEGA FORCE INTERNATIONAL CORP., Taoyuan City (TW)

(72) Inventors: Shih-Che Kung, Taoyuan City (TW); Wei-Hung Chung, Taoyuan City (TW)

(73) Assignee: VEGA FORCE INTERNATIONAL CORP., Taoyuan City (TW)

( * ) Notice: Subject to any disclaimer, the term of this patent is extended or adjusted under 35 U.S.C. 154(b) by 0 days.

(21) Appl. No.: 19/002,005

(22) Filed: Dec. 26, 2024

(65) Prior Publication Data

US 2025/0305795 A1 Oct. 2, 2025

(30) Foreign Application Priority Data

Mar. 27, 2024 (TW) ..... 113111423

(51) Int. Cl.
*F41C 23/16* (2006.01)
*F41G 1/033* (2006.01)

(52) U.S. Cl.
CPC ..... *F41C 23/16* (2013.01); *F41G 1/033* (2013.01)

(58) Field of Classification Search
CPC .... F41A 5/26; F41A 5/28; F41A 21/28; F41C 23/16; F41G 1/033
USPC ..... 42/71.01; 89/191.01, 193
See application file for complete search history.

(56) References Cited

U.S. PATENT DOCUMENTS 4,663,875 A * 5/1987 Tatro ..... F41A 13/12 42/71.01
5,824,943 A * 10/1998 Guhring ..... F41A 5/26 89/192
7,418,898 B1 * 9/2008 Desomma ..... F41A 5/26 89/193
7,461,581 B2 * 12/2008 Leitner-Wise ..... F41A 3/12 89/191.01
7,779,743 B2 * 8/2010 Herring ..... F41A 5/18 89/193
2005/0262752 A1 * 12/2005 Robinson ..... F41A 5/18 42/75.01
2010/0000400 A1 * 1/2010 Brown ..... F41G 1/02 42/111

(Continued)

*Primary Examiner* — Troy Chambers
*Assistant Examiner* — Benjamin S Gomberg
(74) *Attorney, Agent, or Firm* — HDLS IPR SERVICES; Chun-Ming Shih

(57) ABSTRACT

A handguard exhaust structure of a firearm includes: a barrel, a piston mechanism parallelly arranged with the barrel in a length direction and a positioning end, a sleeve extended from the positioning end, and a piston member actuating within the sleeve, two exhaust holes are respectively disposed at two sides of the sleeve and arranged to be adjacent to the positioning end; and a handguard allowing the barrel and the piston mechanism to be disposed therein, two divergent stoppers are respectively disposed on the handguard at locations corresponding to the two exhaust holes, each of the divergent stoppers is formed along a length direction of the handguard, a lower diverter hole and an upper diverter hole penetrating the handguard are disposed at two sides of each of the divergent stoppers. Accordingly, effects of lowering the temperature and prevent hands from being burnt are achieved.

9 Claims, 9 Drawing Sheets

(56) References Cited

U.S. PATENT DOCUMENTS

| | | | | |
|---|---|---|---|---|
| 2011/0265640 | A1* | 11/2011 | Kuczynko | F41A 5/28<br>89/193 |
| 2012/0132068 | A1* | 5/2012 | Kucynko | F41A 5/18<br>42/71.01 |
| 2012/0152104 | A1* | 6/2012 | Audibert | F41A 5/24<br>89/191.01 |
| 2012/0198990 | A1* | 8/2012 | Brittin | F41A 5/26<br>89/191.01 |
| 2016/0033218 | A1* | 2/2016 | Folkestad, II | F41A 3/66<br>42/2 |
| 2022/0018618 | A1* | 1/2022 | Stenzel | F41C 7/00 |

* cited by examiner

HANDGUARD EXHAUST STRUCTURE OF FIREARM

CROSS-REFERENCE TO RELATED APPLICATIONS

This application claims priority to Taiwan Application Serial No. 113111423, filed on Mar. 27, 2024. The content of the aforementioned application is incorporated herein by reference.

BACKGROUND OF THE DISCLOSURE

Technical Field

The present disclosure relates to a firearm, especially to a handguard exhaust structure of a firearm.

Description of Related Art

In a related-art firearm, a bullet is fired out through the combusted gas being ignited by the ammunition in the bullet when the bullet is fired. However, the residual gas is required to be buffered by a piston and a piston rod in the firearm. Residual gas is generated when the ammunition is explored, thus the residual gas is the high-temperature gas. In the design of the related-art firearm, the residual gas is exhausted via a handguard disposed at an outer side of a barrel. As such, a user whose hand holds the handguard is very likely to be burnt and hurt when the user holds the handguard to perform a firing action.

Accordingly, the applicant of the present disclosure has devoted himself for improving the mentioned shortages.

SUMMARY OF THE INVENTION

The present disclosure provides a handguard exhaust structure of a firearm, in which instantly ejected high-temperature gas is diffused to make the high-temperature gas have more contact with air before being exhausted via a handguard to achieve a temperature lowering effect, and the user is prevented from being burnt and hurt by the high-temperature.

Accordingly, the present disclosure provides a handguard exhaust structure of a firearm, which includes a barrel, a piston mechanism and a handguard; the piston mechanism is parallelly arranged with the barrel in a length direction, and includes a positioning end, a sleeve extended from the positioning end, and a piston member actuating within the sleeve, two exhaust holes are respectively disposed at two sides of the sleeve and arranged to be adjacent to the positioning end; the handguard allows the barrel and the piston mechanism to be disposed therein, two divergent stoppers are respectively disposed on the handguard at locations corresponding to the two exhaust holes, each of the divergent stoppers is formed along a length direction of the handguard, a lower diverter hole and an upper diverter hole penetrating the handguard are disposed at two sides of each of the divergent stoppers, thus the high-temperature gas is diverted by the divergent stoppers, and exhausted via the lower diverter hole and the upper diverter hole, and effects of lowering the temperature and prevent hands from being burnt and hurt are achieved.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
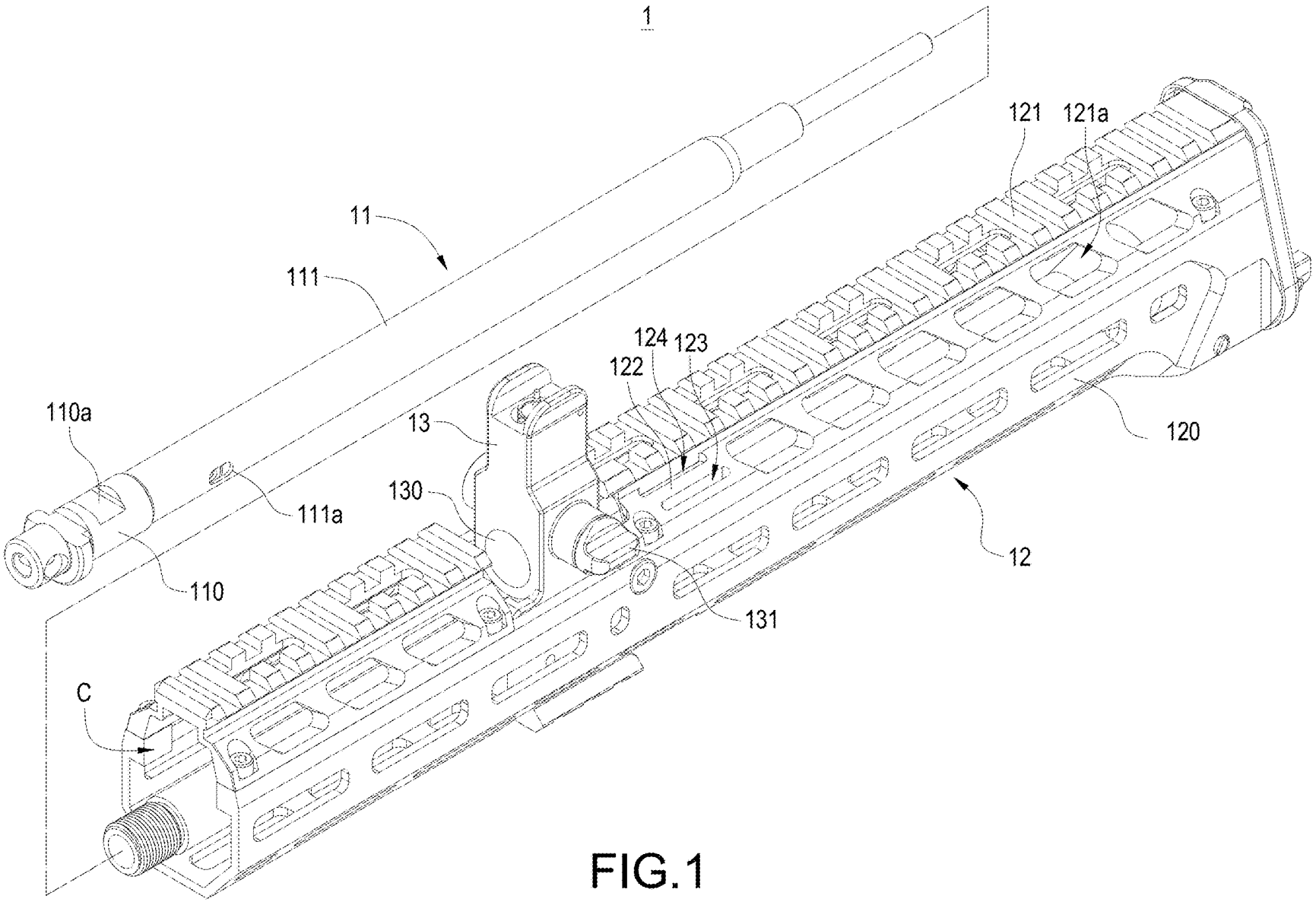
FIG. 1 is a perspective exploded view according to the present disclosure.
Figure 2:
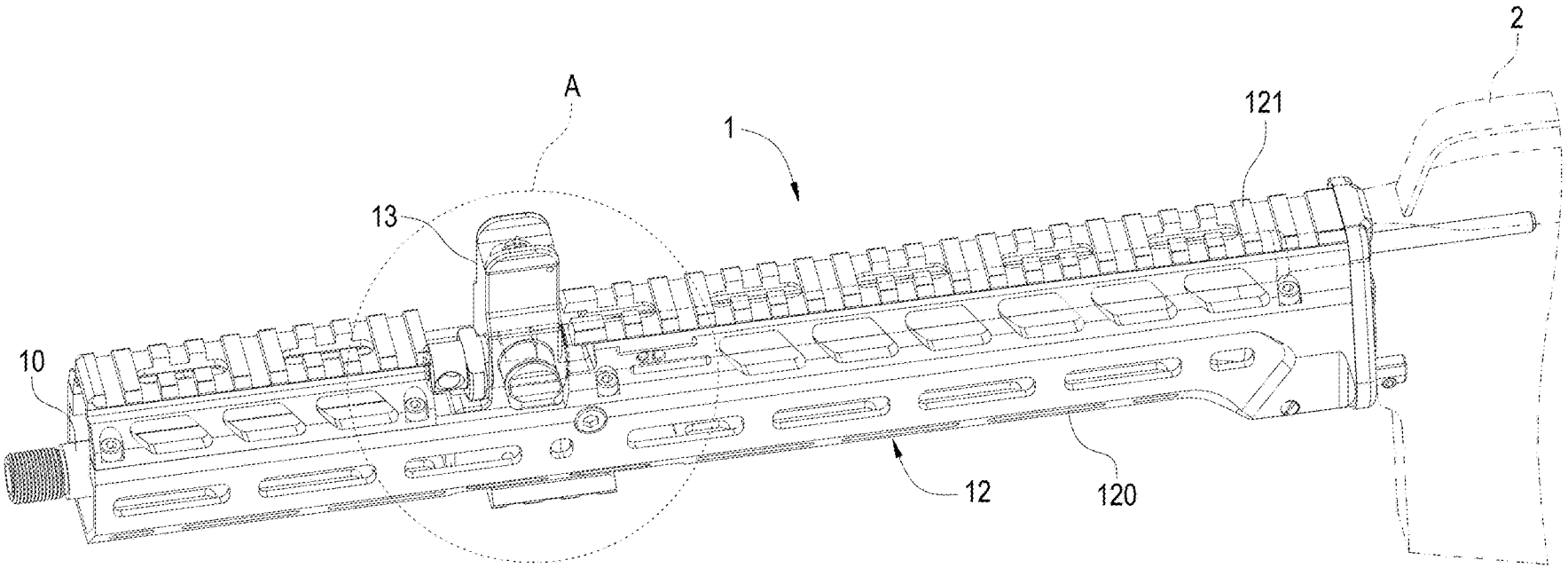
FIG. 2 is a perspective view showing the assembly of the present disclosure being applied in a firearm.

Please refer to FIG. 1 and FIG. 2, wherein FIG. 1 is a perspective exploded view according to the present disclosure, and FIG. 2 is a perspective view showing the assembly of the present disclosure being applied on a firearm. The present disclosure provides a handguard exhaust structure of a firearm, which is assembled with a firearm 2 and disposed at a location, for example, a barrel, of the firearm 2. The firearm 2 is a, for example, military-grade rifle T91 or a toy gun simulating the appearance of the T91. The handguard exhaust structure 1 includes a barrel 10, a piston mechanism 11 and a handguard 12.

The barrel 10 is disposed in the handguard 12. The barrel 10 is combined with the firearm 2 to make a bullet (not shown in figures) be fired via the firearm 2, thus the bullet is fired out by passing the barrel 10. In some embodiments, the appearance of the military-grade refile T91 is provided as an example, and a fireproof cap (not shown in figures) is screwed at a front end of the barrel 10.

The piston mechanism 11 is disposed in the handguard 12. The piston mechanism 11 is parallelly arranged with the barrel 10 by a length direction thereof and located above the barrel 10, thus, ammunition is combusted to make gas explore because the bullet in a magazine (not shown in figures) of the firearm 2 is fired, and when the bullet is fired out from the barrel 10, the excessive gas in the barrel 10 is exhausted via the piston mechanism 11. Please refer to FIG. 3 and FIG. 4, the piston mechanism 11 includes a positioning end 110, a sleeve 111 extended from the positioning end 110, and a piston member 112 disposed movably (actuating) within the sleeve 111, which is pushed by the aforesaid gas. The positioning end 110 is fastened on a sight 13. The sight 13 is protruded from the handguard 12 to an outer side of the handguard 12. The sight 13 has a positioning hole 130 formed in the handguard 12. The positioning end 110 is disposed in the positioning hole 130 with an assembling manner. The sleeve 111 is respectively formed with an exhaust hole 111*a* at two sides thereof adjacent to the positioning end 110, thus the excessive gas generated during the ammunition combustion pushes the piston member 112 to the exhaust holes 111*a* to make the excessive gas exhausted. As shown in FIG. 4, the positioning end 110 has a carbon discharging recessed part 110*b* facing the sleeve 111. A communication hole 110*c* connected to an outer side of the positioning end 110 is formed in the carbon discharging recessed part 110*b*. The sight 13 is formed with a gas channel 132 arranged on an inner wall of the positioning hole 130. The gas channel 132 is defined corresponding to the communication hole 110*c*, thus carbon residues in the gas are collected in the gas channel 132 when the gas generated during the ammunition combustion is exhausted.

Referring to FIG. 1 and FIG. 2, the handguard 12 encloses at an outer side of the barrel 10 and the piston mechanism 11, and by working with the firearm 2, a user may easily hold when the user wants to operate the firearm 2. Moreover, when the handguard 12 is combined with the firearm 2, the handguard 12 abuts against a gun body of the firearm 2 via a plurality of protrusions to prevent the handguard 12 from rotating, thus a problem of not being easily held by the user is solved. In some embodiments, the handguard 12 is configured by a lower handguard 120 and an upper handguard 121 being engaged. A plurality of upper heat dissipating holes 121*a* are formed on the upper handguard 121 to make the barrel 10 and the piston mechanism 11 in the handguard 12 have contact with external air via the upper heat dissipating holes 121*a*, thus a heat dissipating effect is provided to the barrel 10 and the piston mechanism 11.

Figure 4:
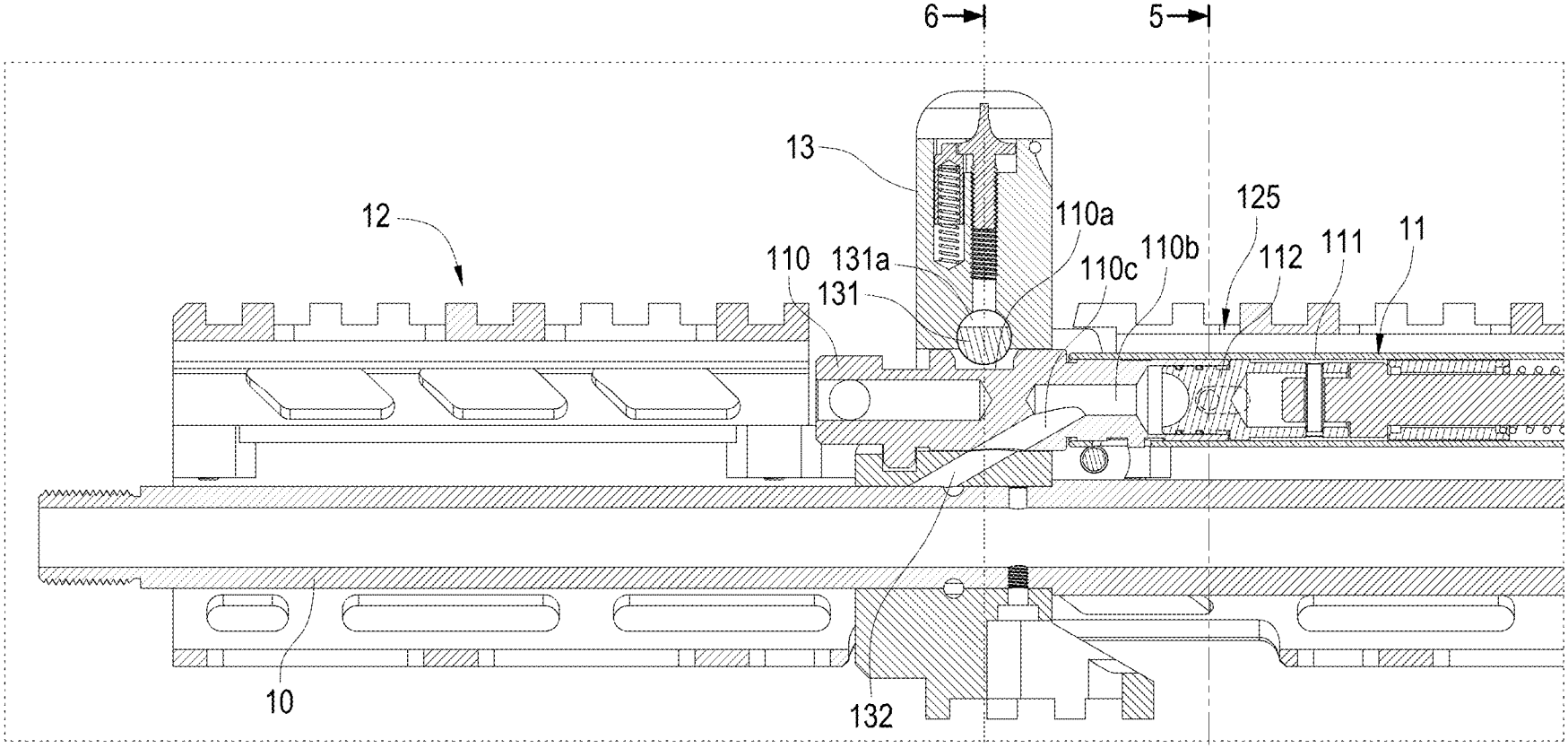
FIG. 4 is a cross-sectional view showing the internal structure according to the present disclosure.
Figure 5:
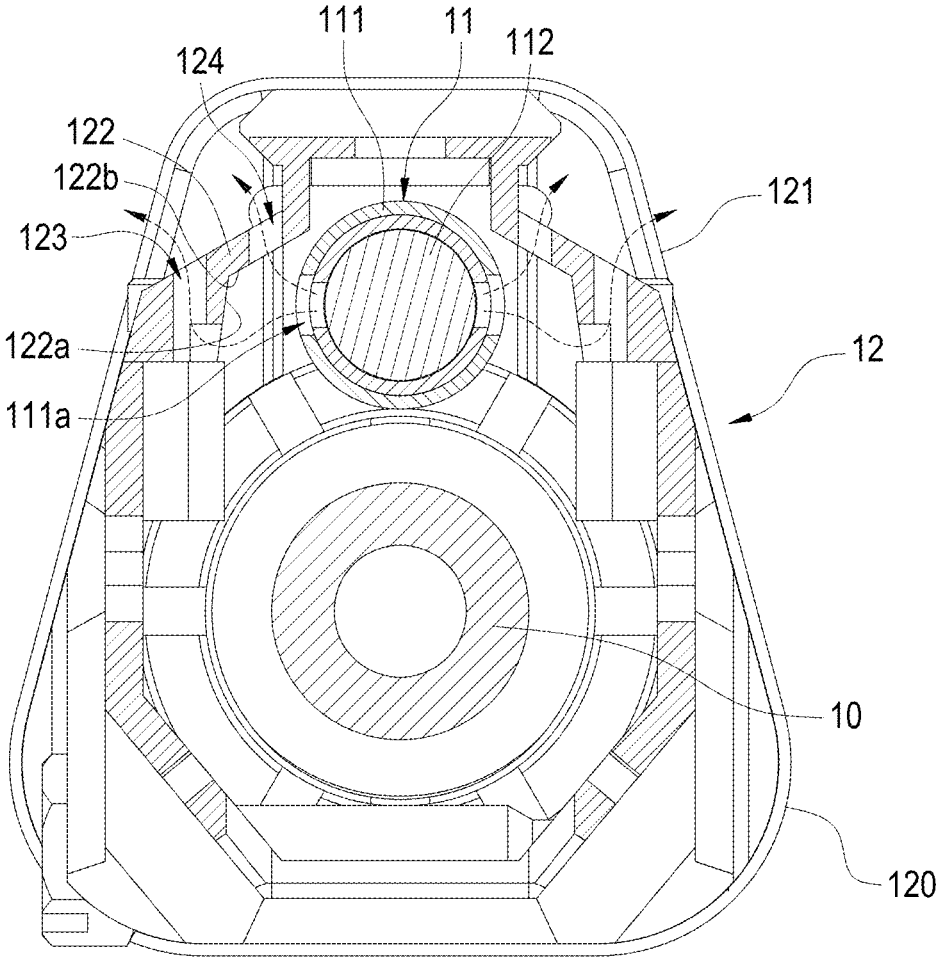
FIG. 5 is a cross-sectional view taken along a 5-5 cross section of FIG. 4.

Referring to FIG. 4 and FIG. 5, a divergent stopper 122 is respectively disposed on the handguard 12 at locations corresponding to the exhaust holes 111*a* of the piston mechanism 11. The divergent stopper 122 is formed along a length direction of the handguard 12, and a cross-sectional surface is formed in an L shape. The divergent stopper 122 has a lower guide surface 122*a* and an upper guide surface 122*b*. A lower diverter hole 123 and an upper diverter hole 124 penetrating the handguard 12 are disposed at two sides the divergent stopper 122. The lower guide surface 122*a* is formed by being extended towards the lower diverter hole 123. The upper guide surface 122*b* is formed by being extended towards the upper diverter hole 124. As such, when the gas is exhausted via the exhaust holes 111*a* of the piston mechanism 11, the gas is blocked by the divergent stoppers 112 to be diverted, and one part of the gas is guided to the lower diverter hole 123 along the lower guide surface 122*a*, the other part of the gas is guided to the upper diverter hole 124 along the upper guide surface 122*b*, thus the instantly ejected high-temperature gas is firstly diffused in the handguard 12 to make the high-temperature gas have more contact with air to achieve a temperature lowering effect, and a situation of the high-temperature gas being concentrated and directly discharged from the handguard 12 is avoided, thus the user holding the handguard 12 is prevented from being burnt and hurt in the high-temperature status.

Accordingly, the handguard exhaust structure of the firearm of the present disclosure is assembled with the aforesaid configurating manner.

Figure 6:
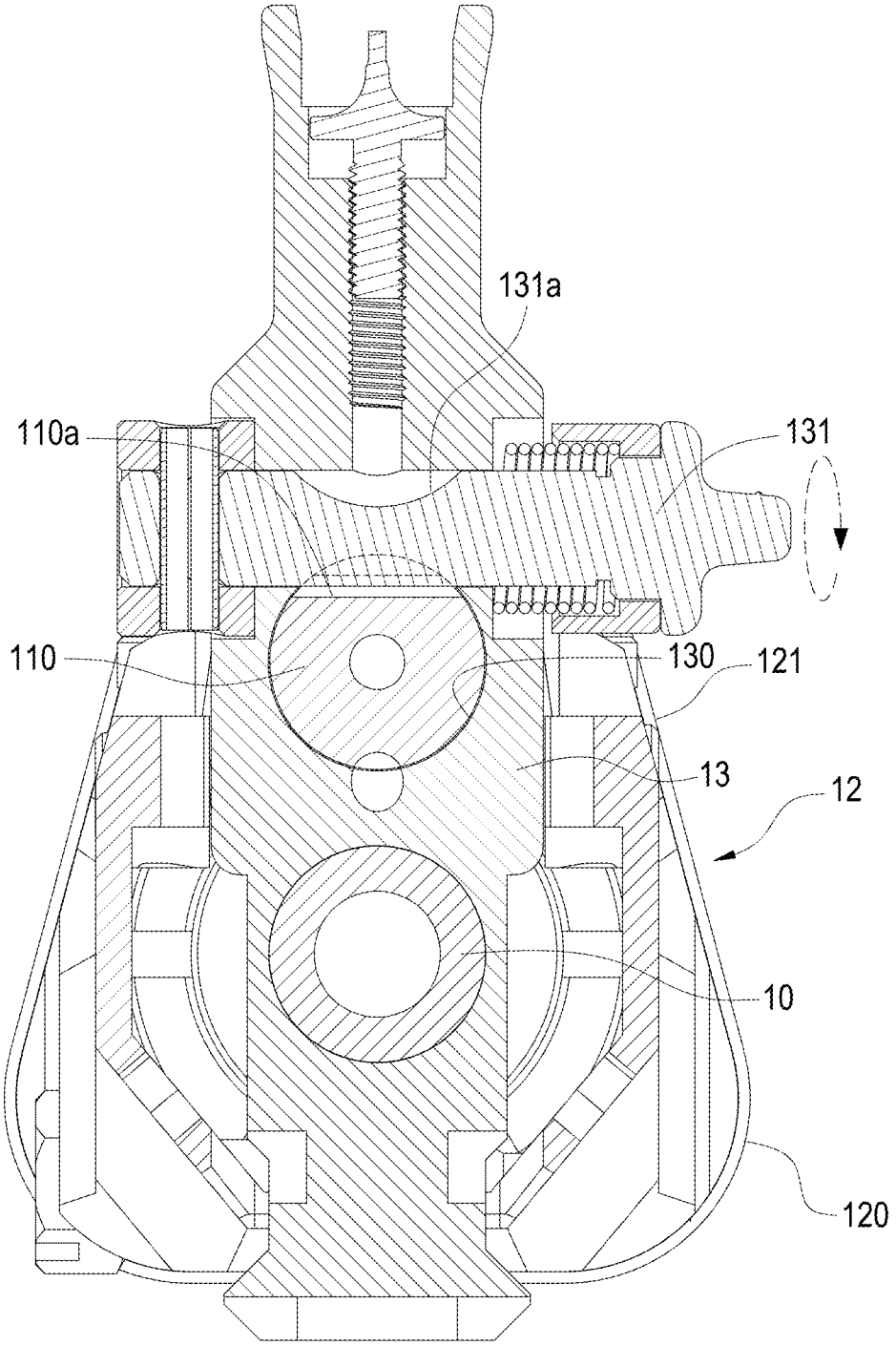
FIG. 6 is a cross-sectional view taken along a 6-6 cross section of FIG. 4.

Referring to FIG. 1, FIG. 4, and FIG. 6, for providing an easy to be detached and maintained effect to the assembly of the piston mechanism 11 and the sight 13 provided by the present disclosure, a position limiting slot 110*a* is concavely formed at the positioning end 110 of the piston mechanism 11, and the sight 13 has a fasten shaft 131 partially passing the positioning hole 130. The fasten shaft 131 is concavely formed with a notch 131*a* at a location corresponding to the positioning hole 130. As shown in FIG. 4 and FIG. 6, when the positioning end 110 is positioned in the positioning hole 130, the fasten shaft 131 is partially disposed in the position limiting slot 110*a*, and the positioning end of the piston mechanism 11 is limited in the position limiting slot 110*a*.

Figure 7:
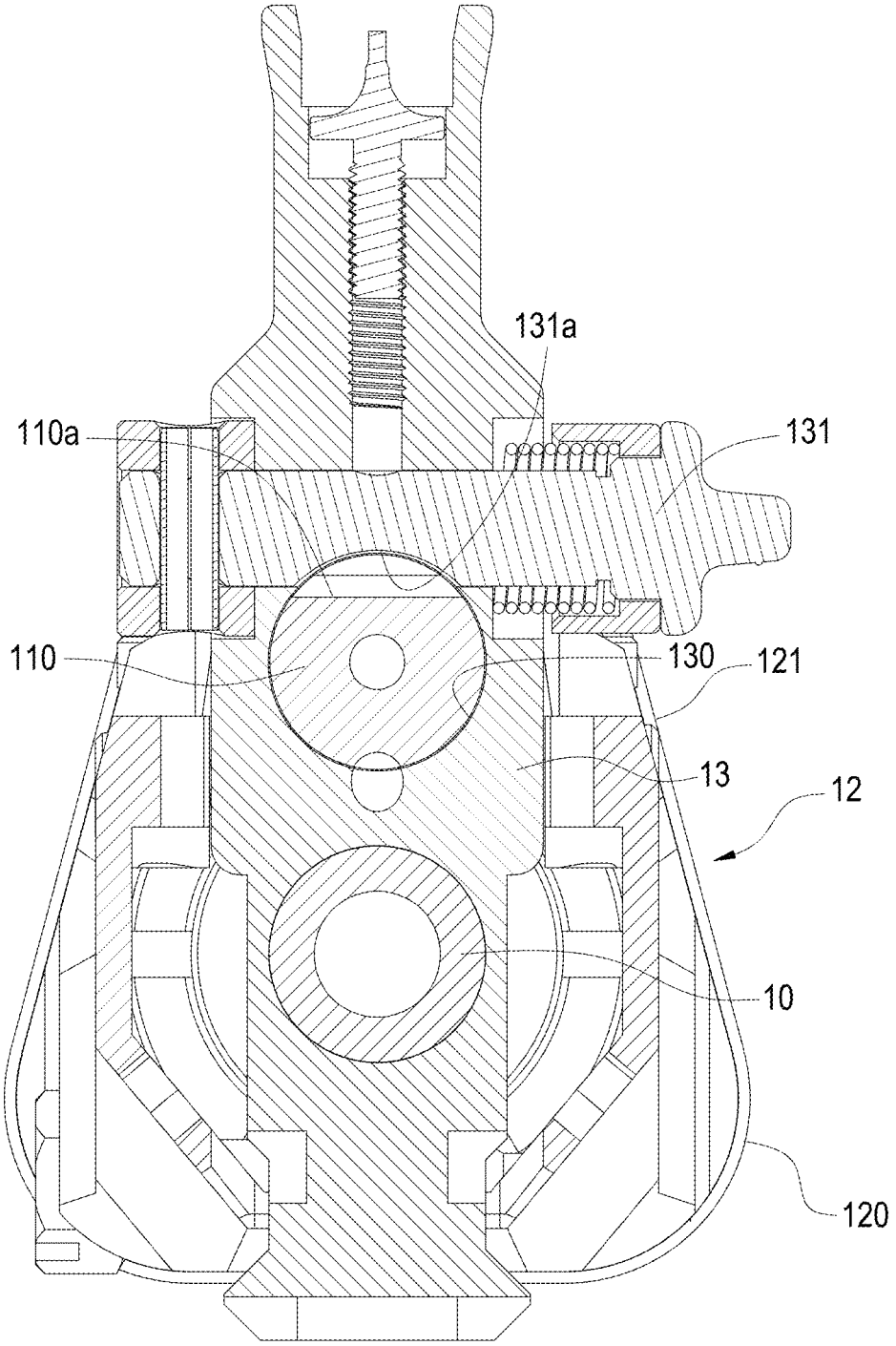
FIG. 7 is a schematic view showing an operating status of FIG. 6.
Figure 8:
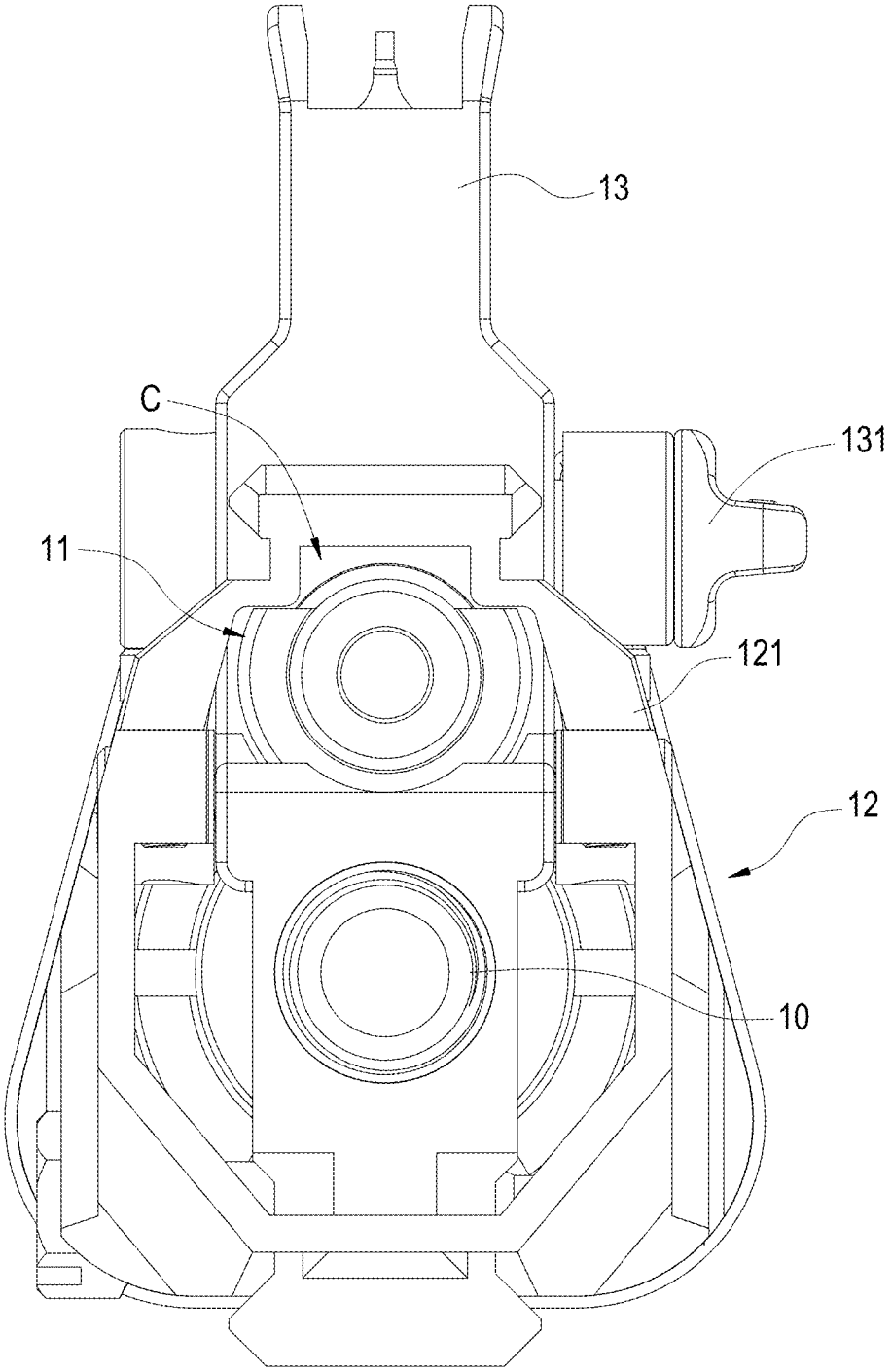
FIG. 8 is a schematic view showing the end surface according to the present disclosure.

Please refer to FIG. 6 and FIG. 7, when the piston mechanism 11 needs be detached, the fasten shaft 131 is pivotally rotated to make the notch 131*a* of the fasten shaft 131 face the position limiting slot 110*a*, the piston mechanism 11 passes an opening C (as shown in FIG. 8) at a front end of the handguard 12 and is removed from the positioning hole 130 with a manner of the shape of the notch 131*a* and the end surface of the positioning end 110 being mutually matched (for example configured as a circular shape). As such, operations, for example maintenance or replacement, are provided to the piston mechanism 11.

Figure 3:
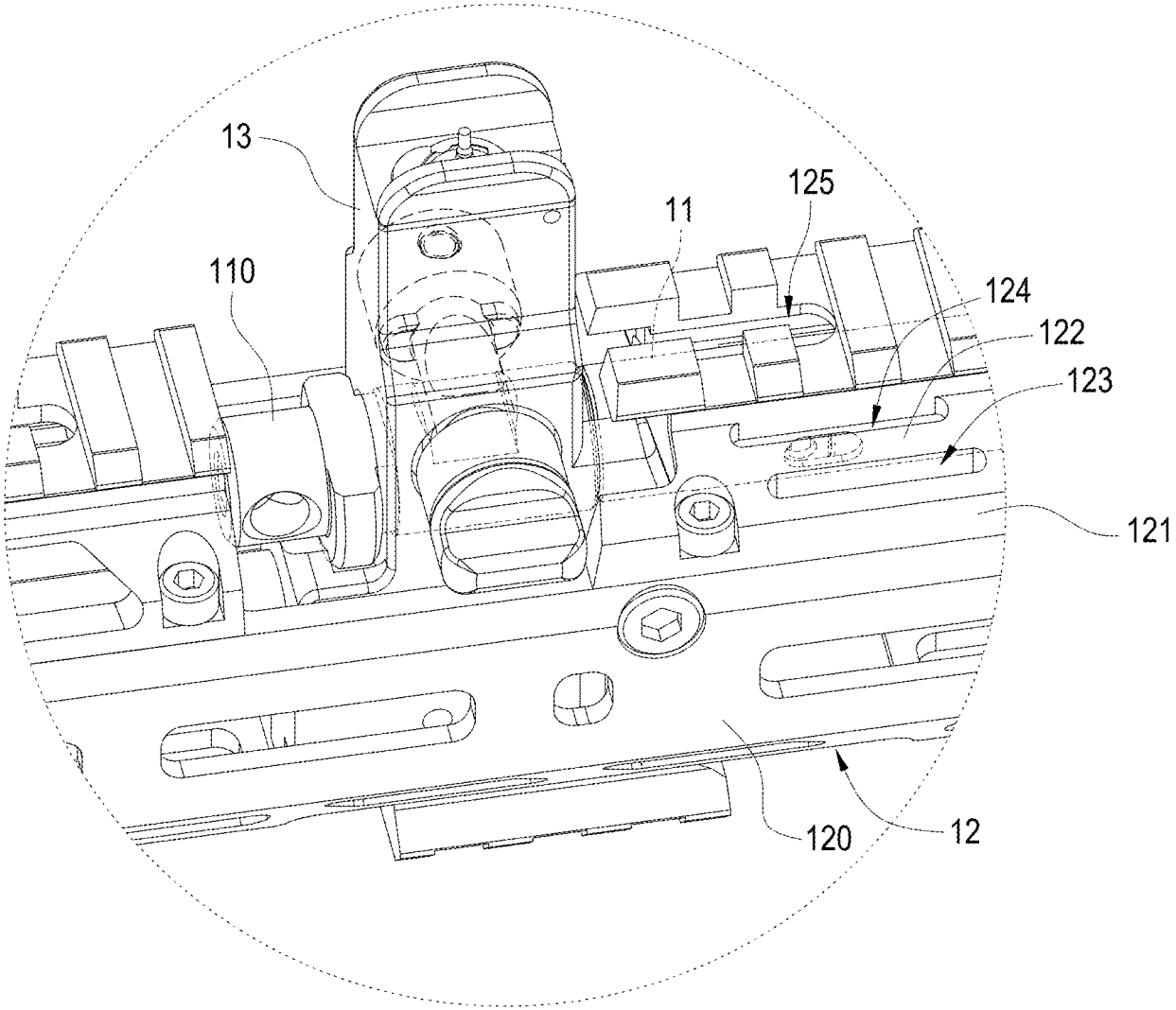
FIG. 3 is a partially enlarged view of an A section of FIG. 2.
Figure 9:
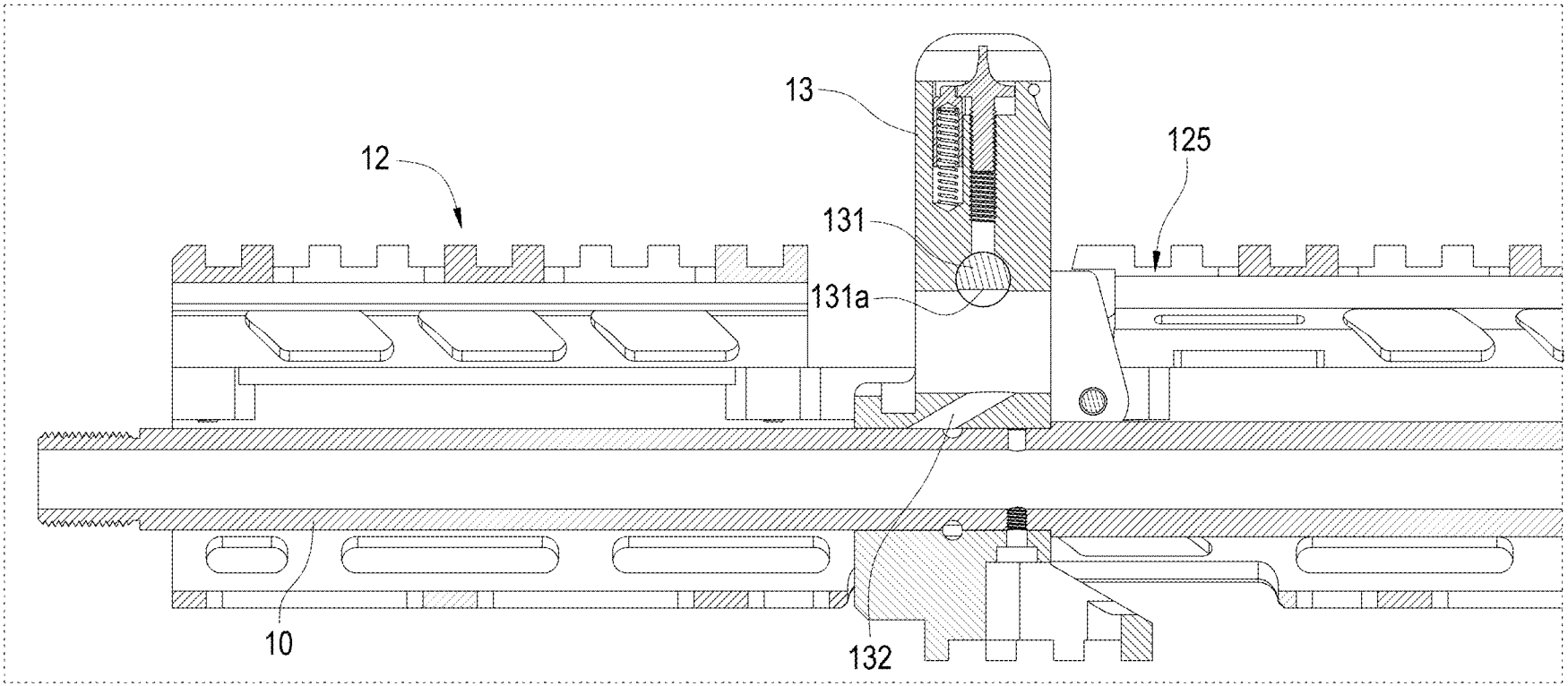
FIG. 9 is a cross-sectional view showing the internal structure after the piston mechanism being detached according to the present disclosure.

Referring to FIG. 9, for easily cleaning and maintaining the gas channel 132 in the sight 13, an open slot 125 (as shown in FIG. 3) is formed on the handguard 12. The open slot 125 is arranged to be adjacent to the sight 13, a cleaning tool (not shown in figures) disposed at an outer side of the handguard 12 passes the open slot 125 to enter the gas channel 132, thus the gas channel 132 is cleaned and maintained without a need of detaching the handguard 12.

While this disclosure has been described by means of specific embodiments, numerous modifications and variations may be made thereto by those skilled in the art without departing from the scope and spirit of this disclosure set forth in the claims.

What is claimed is:

1. A handguard exhaust structure, comprising:

a barrel;

a piston mechanism, parallelly arranged with the barrel in a longitudinal direction thereof, comprising a positioning end, a sleeve extended from the positioning end, and a piston member disposed movably in the sleeve, wherein two exhaust holes are respectively disposed at two sides of the sleeve and arranged adjacent to the positioning end; and a handguard, the barrel and the piston mechanism being disposed therein, wherein two divergent stoppers are respectively disposed on the handguard at locations corresponding to the two exhaust holes, each of the divergent stoppers is disposed along a longitudinal direction of the handguard, and a lower diverter hole and an upper diverter hole penetrating the handguard are disposed at two sides of each of the divergent stoppers.

2. The handguard exhaust structure according to claim 1, furthering comprising a sight, disposed protrusively from the handguard to an outer side thereof.

3. The handguard exhaust structure according to claim 2, wherein the sight comprises a positioning hole located in the handguard, and the positioning end is disposed in the positioning hole.

4. The handguard exhaust structure according to claim 3, wherein the sight further comprises a fasten shaft partially passing the positioning hole, the fasten shaft comprises a notch disposed concavely corresponding to the positioning hole, and the notch and an end surface of the positioning end correspond in shape.

5. The handguard exhaust structure according to claim 4, wherein a position limiting slot is disposed concavely at the positioning end, and the fasten shaft is partially disposed in the position limiting slot.

6. The handguard exhaust structure according to claim 4, wherein the handguard comprises an open slot, and the open slot is arranged to be adjacent to the sight.

7. The handguard exhaust structure according to claim 3, wherein the positioning end comprises a carbon discharging recessed part facing the sleeve, a communication hole connected to an outer side of the positioning end is defined in the carbon discharging recessed part, and the sight comprises a gas channel defined on an inner wall of the positioning hole.

8. The handguard exhaust structure according to claim 1, wherein the handguard comprises a lower handguard and an upper handguard engaged with each other, and the upper handguard comprises a plurality of upper heat dissipating holes.

9. The handguard exhaust structure according to claim 1, wherein a cross-sectional surface of each of the divergent stoppers is L-shaped, and each of the divergent stoppers comprises a lower guide surface and an upper guide surface, wherein the lower guide surface is extended towards the lower diverter hole, and the upper guide surface is extended towards the upper diverter hole.

* * * * *